United States Patent [19]

Litman

[11] Patent Number: 4,588,116

[45] Date of Patent: May 13, 1986

[54] HOLSTER FOR A CHEMICAL TEAR GAS PROJECTOR

[75] Inventor: Alan Litman, North Key Largo, Fla.

[73] Assignee: Smith & Wesson Chemical Company, Inc., Rock Creek, Ohio

[21] Appl. No.: 653,169

[22] Filed: Sep. 24, 1984

Related U.S. Application Data

[63] Continuation of Ser. No. 556,226, Nov. 29, 1983, abandoned, which is a continuation of Ser. No. 347,407, Feb. 10, 1982, abandoned.

[51] Int. Cl.[4] ..... A45F 5/00

[52] U.S. Cl. ..... 224/253; 224/914; 224/148

[58] Field of Search ..... 224/253, 250, 242, 232, 224/192, 148, 904, 911, 914

[56] References Cited

U.S. PATENT DOCUMENTS 1,605,195 11/1926 Lewis ..... 224/148

3,445,046 5/1969 Wilson ..... 224/148

*Primary Examiner*—Stephen Marcus

*Assistant Examiner*—David Voorhees

*Attorney, Agent, or Firm*—Patrick J. Walsh

[57] ABSTRACT

Disclosed is a holster for a chemical tear gas projector having an elongated body with opposite first and second end portions and an intermediate portion therebetween. The first end portion carries a receptacle for receiving the projector. The second end portion is folded to extend behind and parallel the intermediate and first end portions to define an opening for receiving a belt. Projections carried by the second end portion interlock with recesses on the intermediate portion to define the extent of the opening and assist in preventing rotational or swinging movement of the holster relative to the belt portion received through the opening. Additional projections are carried by the holster body and are removable whereby the size of the opening can be adjusted to accommodate belts of different sizes.

16 Claims, 9 Drawing Figures

HOLSTER FOR A CHEMICAL TEAR GAS PROJECTOR

This is a continuation of application Ser. No. 556,226, filed Nov. 29, 1983, now abandoned which is a continuation of Ser. No. 347,407 filed Feb. 10, 1982 now abandoned.

BACKGROUND OF THE INVENTION

The present invention relates to a holster and particularly relates to a holster for carrying a chemical tear gas projector from an equipment belt, for example, the equipment belt conventionally worn by a law enforcement officer.

Chemical tear gas projectors are frequently carried by law enforcement officers and are generally utilized by such officers to project a stream of fluid comprised of tear gas or other chemical agent at an individual or group of individuals. The chemical agent, e.g., tear gas, effectively incapacitates such individuals. As a consequence, many law enforcement agencies have adopted chemical tear gas projectors of this type as a standard piece of equipment for their personnel.

Typically, such chemical tear gas projector comprises a generally cylindrically shaped canister containing the chemical agent under pressure. A dispensing nozzle and actuator button are provided adjacent the top of the canister. To utilize the chemical tear gas projector, the officer or other individual using the projector grasps the canister in one hand, aims the nozzle in the direction of the target individual and depresses the actuator button causing the tear gas to be projected from the canister through the nozzle to the target individual in the form of a directed stream. One such chemical tear gas projector is the MK-V1 Chemical Mace tear gas projector manufactured by the Smith & Wesson Company, Springfield, Mass.

It has been found convenient for law enforcement officers to carry the chemical tear gas projector on the same belt from which other law enforcement equipment is carried, for example the officer's revolver. However, because of the unique shape of the canister containing the chemical agent, the need to releasably secure the projector in the holster in a manner providing for quick access to the projector, the desirability of utilizing a single holster for use with different size equipment belts, and the need to provide stability and rigidity to the holster and chemical tear gas projector carried thereby relative to the belt, that is, the need to prevent the combined holster and projector from pivoting or swinging movement relative to the belt, there is thus an established requirement for a new and unique holster for carrying a chemical tear gas projector from the equipment belt, for example, worn by law enforcement officers.

SUMMARY OF THE INVENTION

It is a primary object of the present invention to provide a novel and improved holster for carrying a chemical tear gas projector.

It is another object of the present invention to provide a novel and improved holster for a chemical tear gas projector and which holster is provided with an opening adjustable to receive equipment belts of different sizes.

It is still another object of the present invention to provide a novel and improved holster for a chemical tear gas projector wherein the holster has lateral stability, that is, the holster is substantially prevented from rotating or pivotal movement relative to the portion of the equipment belt directly supporting the holster.

It is a further object of the present invention to provide a novel and improved holster for carrying a chemical tear gas projector having the foregoing characteristics and which is of simple and unitary construction.

Additional objects and advantages of the present invention will be set forth in part in the description which follows and in part will be obvious from the description, or may be learned by practice of the invention. The objects and advantages of the invention may be realized and attained by means of the instrumentalities and combinations particularly set forth in the appended claims.

To achieve the foregoing and other objects and advantages and in accordance with the purposes of the present invention, as embodied and broadly described herein, a holster for a chemical tear gas projector constructed in accordance with the present invention may comprise an elongated holster body having first and second end portions and an intermediate portion therebetween. The first end portion includes an upwardly opening receptacle on one side of the holster body for receiving a portion of the chemical tear gas projector. The second end portion extends along the opposite side of the holster body adjacent and generally parallel to the intermediate portion thereof and defines therewith an opening for receiving a belt for supporting the holster therefrom. Means are provided for releasably securing the first and second end portions of the holster body one to the other. Means carried by the intermediate portion of the holster body and spaced from the receptacle for releasably engaging the chemical tear gas projector to retain the latter in the receptacle are also provided.

In a preferred embodiment of the present invention, means are carried by the holster body for adjusting the size of the opening to enable the holster to be carried by belts of different sizes. The adjusting means may include first and second projections carried by one of the second end portion and the intermediate portion and projecting toward the other of the second end portion and the intermediate portion, the projections being spaced vertically one from the other with the first projection being removably carried by the holster body, the first projection defining a part of the opening of a first predetermined size and positioned to form an abutment against which a belt of a first predetermined size may abut, the second projection defining a part of the opening of a second predetermined size and forming an abutment against which a belt of a second predetermined size may abut upon removal of the first projection from the holster body.

In another preferred embodiment of the present invention, there is provided means carried by the holster body and engageable with the belt for substantially preventing rotational movement of the holster body relative to the portion of the belt received in the opening. Preferrably such means includes a pair of projections carried by one of the second end portion and the intermediate portion and spaced laterally one from the other to define a part of the opening and from a pair of laterally spaced abutments against which the belt may abut.

The accompanying drawings which are incorporated in and constitute a part of this specification, illustrate one embodiment of the present invention and, together with the description, serve to explain the principles of the invention.

DESCRIPTION OF A PREFERRED EMBODIMENT

Reference will now be made in detail to the preferred embodiment of the present invention, an example of which is illustrated in the accompanying drawings.

Figure 1:
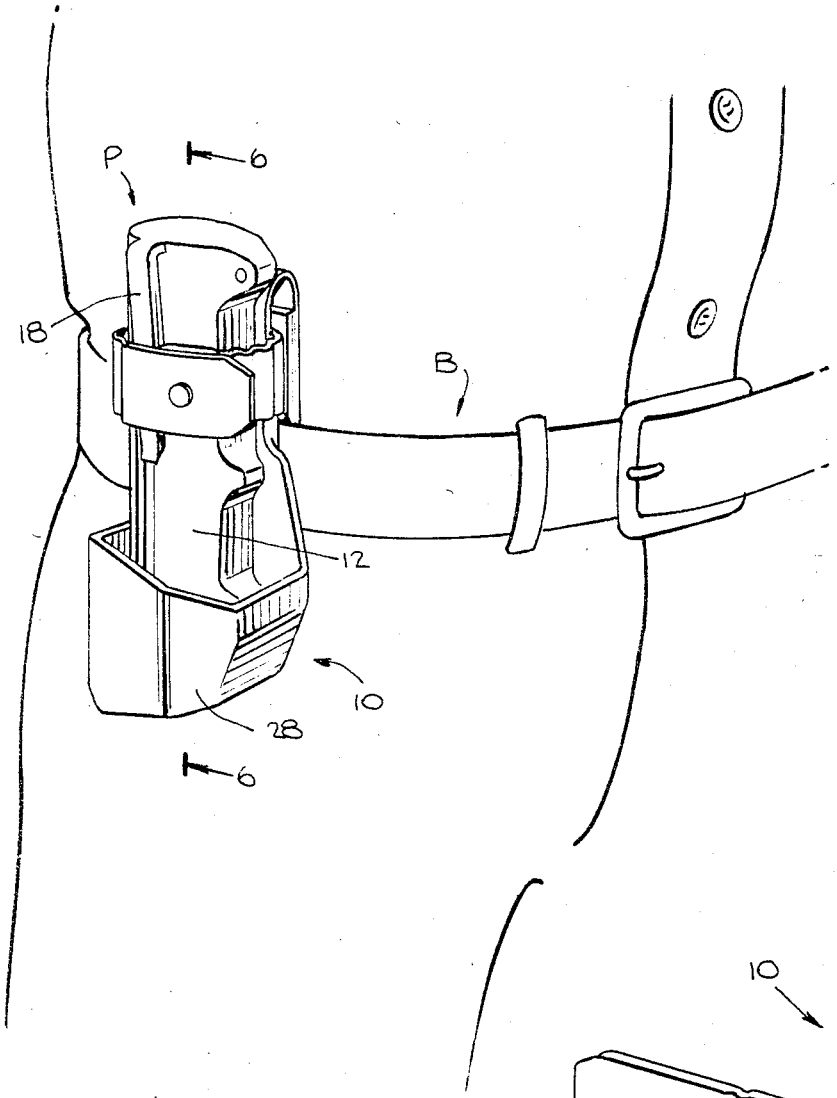
FIG. 1 is a perspective view of a holster for a chemical tear gas projector constructed in accordance with the present invention and illustrated attached to an equipment belt worn by an individual carrying the holster and chemical tear gas projector.
Figure 2:
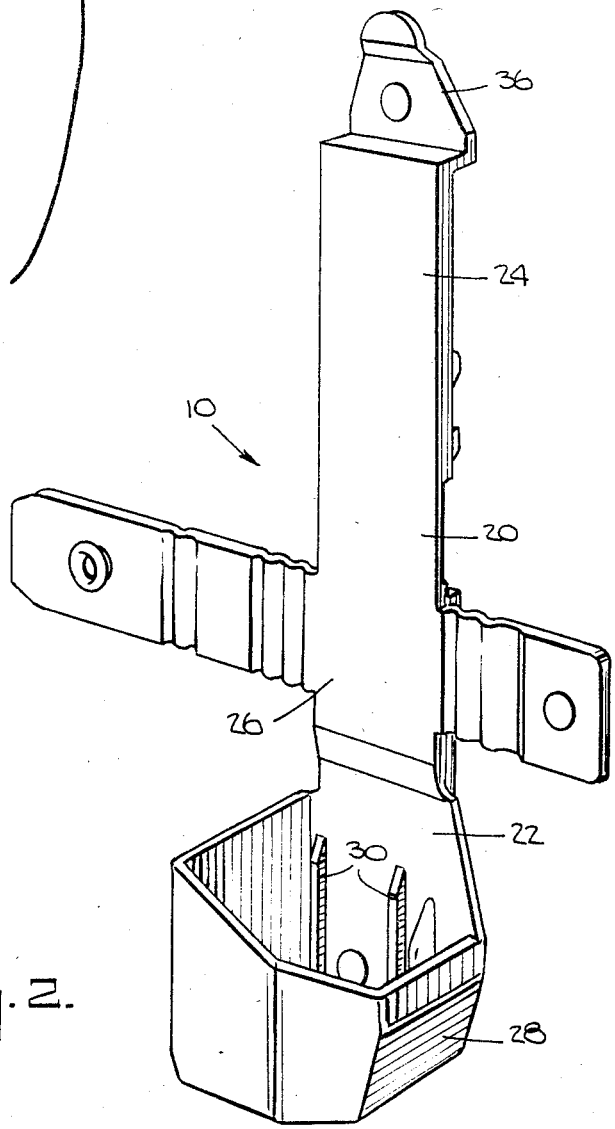
FIG. 2 is a perspective view of the holster hereof in a flat condition and viewed from its front side.

Referring now to the drawings, particularly to FIGS. 1 and 2, there is illustrated a holster, generally designated 10, constructed in accordance with the present invention. Holster 10 is illustrated carrying a chemical tear gas projector, generally designated P. Chemical tear gas projector P is described in detail in copending application Ser. No. 697057 filed 1-31-85 and per se forms no part of the present invention. For purposes of facilitating an understanding of the present invention, however, chemical tear gas projector P comprises a generally cylindrical canister 12 having at one end an actuator button 14 accessible through an opening 16 on one side of the canister and a nozzle on the side thereof opposite access opening 16. Canister 12 is shaped along one side thereof to provide a grip for an individuals hand and a clip 18 is provided along one side and toward the opposite end of the canister from button 14. Clip 18 serves as an alternate means than a holster for carrying the projector P. Further details of the tear gas projector P may be obtained by reference to the above identified copending patent application.

Figure 8:
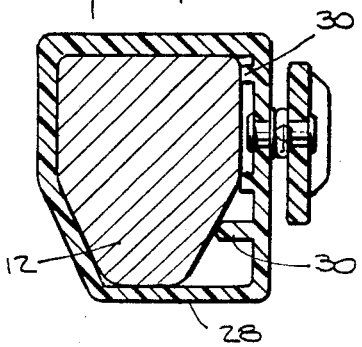
FIG. 8 is a cross sectional view of the holster and chemical tear gas projector illustrated in FIG. 6 and taken generally about on line 8—8 in FIG. 6.

It will be appreciated from a review of the drawings and the ensuing description that canister 12 is carried by holster 10 in an inverted orientation. That is, actuator button 14 is normally located at the upper end of the projector when the latter is in use. It will also be appreciated from a review of the drawings that canister 12 is generally hexagonal in cross sectional shape as illustrated in FIG. 8.

Holster 10 is preferrably of unitary construction as described in detail hereinafter and includes an elongated holster body 20 having first and second end portions 22 and 24, respectively, and an intermediate portion 26 therebetween. As best illustrated in FIG. 2, first or lower end portion 22 includes an upwardly opening receptacle 28 for receiving the inverted upper end of chemical tear gas projector P. Receptacle 28 has five discrete sides and is thus generally shaped to receive the upper hexagonal end of canister 12 as illustrated in FIG. 8. To provide a snug friction fit for the upper end of canister 12, a plurality of laterally spaced ribs 30 project into receptacle 28 from the inner side wall of first end portion 22 for engagement with adjacent sides of the hexagonal upper end of the canister, the ribs being flexible facilitating both a snug fit and ease of withdrawal of projector P from holster 10. The lower end of first end portion 22 carries the male portion 32 of a snap fastener for reasons discussed hereinafter.

Figure 3:
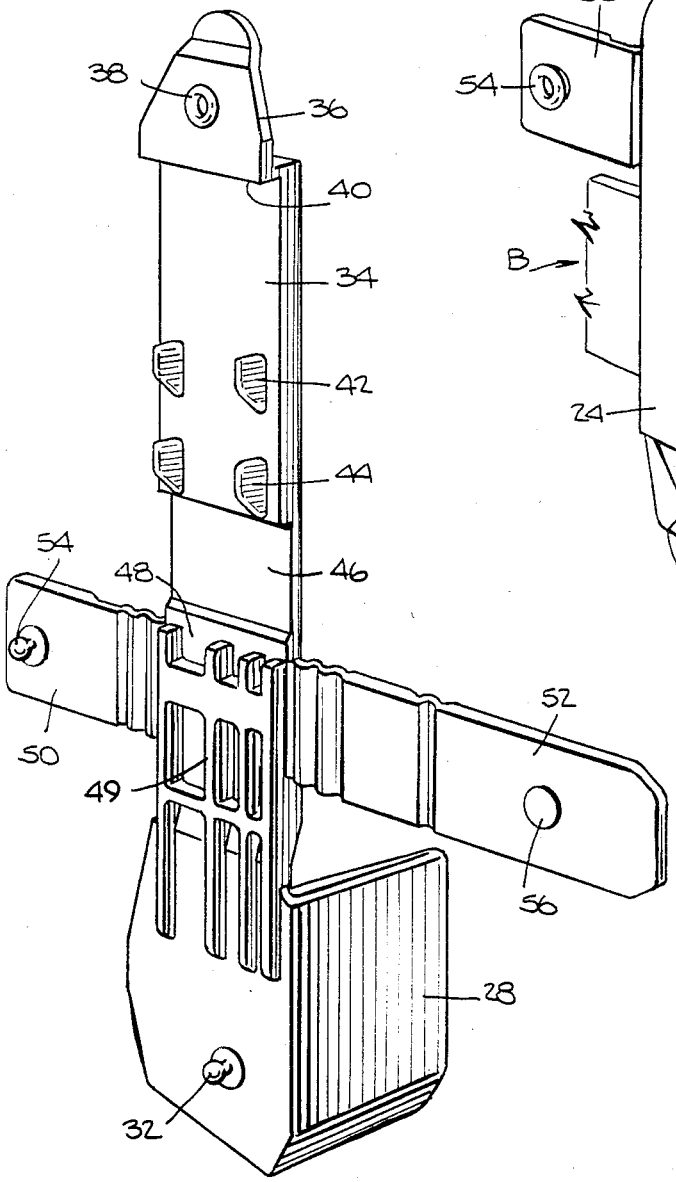
FIG. 3 is a perspective view of the holster hereof similar to FIG. 2 and illustrating the back or rear side of the holster.
Figure 4:
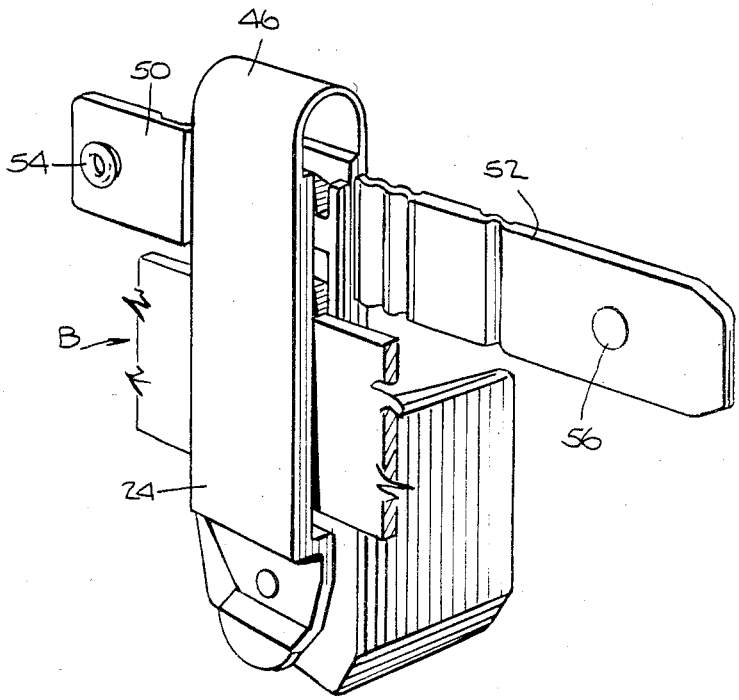
FIG. 4 is a perspective view of the holster hereof taken from its rear side and illustrating the holster attached to the equipment belt but without the chemical tear gas projector therein.
Figure 5:
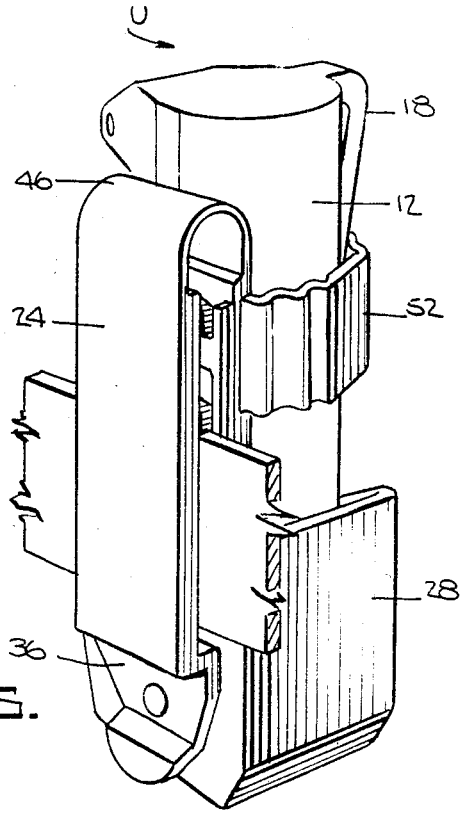
FIG. 5 is a view similar to FIG. 4 illustrating the chemical tear gas projector releasably secured within the holster.

The second or upper end portion 24 is thickened at 34 and carries an end tab 36. Tab 36 carries the female portion 38 of the snap fastener which similarly projects to the rear side of upper end portion 24. Tab 36 and thickened portion 34 form a flange 40 which extends the full width of second end portion 24 for reasons which will become apparent. As best illustrated in FIG. 3, the rear face of thickened portion 34 of upper end portion 24 carries first and second pairs of projections 42 and 44, respectively, and which pairs are vertically spaced one from the other. The projections of each pair thereof are laterally spaced one from the other and are located adjacent opposite lateral edges of second end portion 24. A reduced thickness portion 46 connects the thickened portion 34 and intermediate portion 26 thereby providing flexibility and enabling the second or upper end portion 24 to be bent or folded from the position illustrated in FIGS. 4–7 as described in detail hereinafter.

Figure 6:
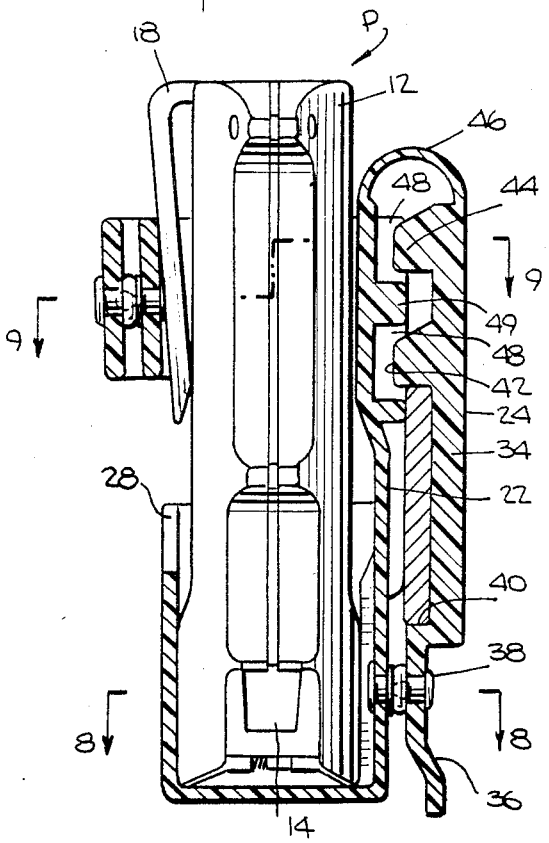
FIG. 6 is a vertical cross sectional view of the holster with the chemical tear gas projector therein and illustrated attached to an equipment belt of a first predetermined size.
Figure 7:
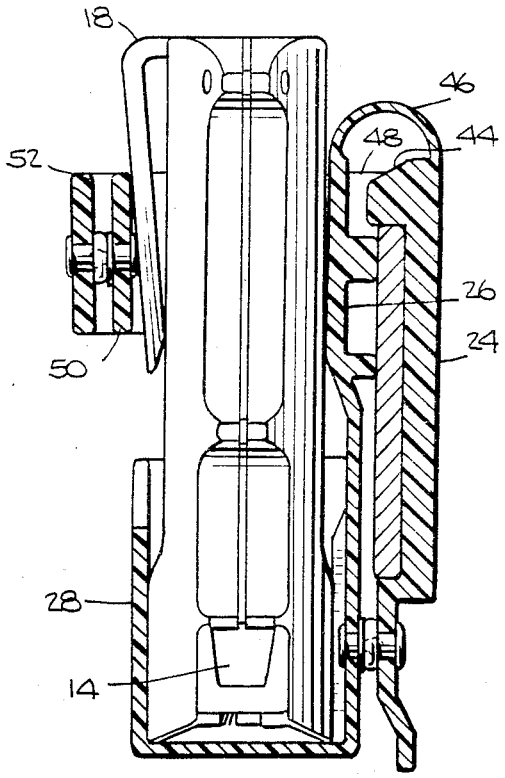
FIG. 7 is a view similar to FIG. 6 illustrating the holster adjusted for attachment to an equipment belt of a second predetermined size.
Figure 9:
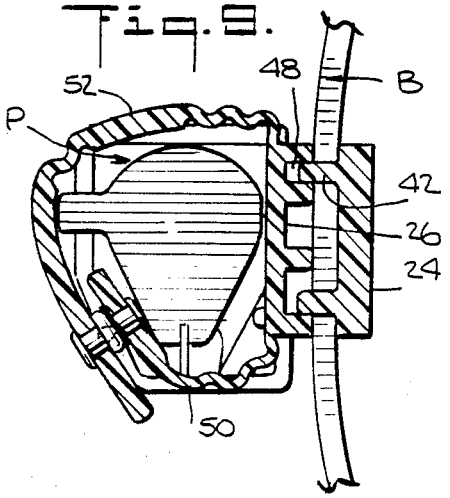
FIG. 9 is a cross sectional view of the holster and chemical tear gas projector illustrated in FIG. 6 and taken generally about on line 9—9 in FIG. 6.

Intermediate portion 26 is offset outwardly from the first or lower end portion 22 as best illustrated in FIGS. 6 and 7 and is provided along its inner face with a plurality of laterally and vertically spaced openings or recesses 48 defined by ribs 49. Laterally outer openings 48 lie in registration with corresponding projections 42 and 44 respectively when the upper or second end portion is bent or folded into the position illustrated in FIGS. 4–7 as described hereinafter. Intermediate portion 26 also includes a pair of straps 50 and 52 extending respectively from opposite side edges thereof. Each strap is connected to intermediate portion 26 by a reduced thickness section which provides flexibility and facilitates bending of straps 50 and 52 about projector P as illustrated in FIG. 9. Straps 50 and 52 carry the male and female portions 54 and 56, respectively, of a snap fastener so that when the straps are engaged about projector P and secured one to the other by the snap fastener projector P is releasably retained in receptacle 28.

Preferrably, holster 10 hereof is of unitary construction. For example, holster 10 may be formed of a plastic material, such as polyurethane or some other thermoplastic elastomer. Alternatively, holster 10 may be formed of leather with discrete individual pieces being formed and secured one to the other in a manner well known but in the configuration described and illustrated.

To utilize the holster hereof, the upper or second end portion 24 is bent or folded about portion 36 into a position extending generally parallel and in opposition to the back or rear face of intermediate portion 26. The male and female portions 32 and 34, respectively, of the snap fastener are secured one to the other whereby the second or upper end portion 24 is releasably secured to the first or lower end portion 22. In this position, it will be appreciated that projections 42 and 44 register with and are received within corresponding recesses 48 as illustrated in FIG. 6. Importantly, from a review of FIG. 6, it will also be appreciated that the inner faces of thickened portion 34 of the second end portion, the ribs 49 of intermediate portion 26, the flange 40 and the edges of the first projections 42 define an opening for receiving an equipment belt B of a first predetermined size. It will further be readily appreciated that belt B can be passed or slipped through the opening thus defined or the upper or second end portion 24 can be bent or folded about the belt B to secure the holster to the belt with the belt located between the intermediate and upper end portions 26 and 20, respectively. Chemical tear gas projector B may then be inverted and its upper end disposed in receptacle 28. Straps 50 and 52 may then be engaged about the lower end of projector P and releasably secured one to the other.

It is a feature of the present invention that the holster, when secured to belt B, is stable relative to the portion of the belt passing through the opening defined between the second and intermediate portions 24 and 26, respectively. That is, means are carried by the holster body and engageable with the belt for substantially preventing rotational movement of the holster body relative to the portion of the belt passing within the holster body and thus the holster cannot swing laterally or pivot relative to the belt portion received within the holster. To achieve such stability and in a preferred embodiment of the present invention, it will be appreciated that flange 40, abutments defined by projections 42, the thickened intermediate portion 34, and the ribs 49 carried by intermediate portion 26 provide substantial rigid constraints about belt B such that the holster cannot swing about an axis perpendicular to or pivot about a lateral axis wholly within the belt portion received within the holster. The holster is thus optimally constrained against such movement. Note that projections 42 bear against the outer edges of ribs 49 which define the outermost recesses 48. This provides lateral stability, e.g. prevents relative lateral movement of the intermediate and end portions 26 and 24, respectively, in a sideways direction. Thus the holster is substantially rigidly secured to the belt and yet can also be readily released from the belt simply by unfastening the snap fastener joining the opposed end portions 22 and 24 one to the other.

It is also an important feature of the present invention that means are provided on the holster body for adjusting the size of the opening receiving the belt to enable the holster to be carried by belts of different sizes. To accomplish this, and in a preferred embodiment hereof, the belt opening between the flange 40 and first projections 42 may be enlarged to accomodate a belt of a larger size by removing the first set or pair of projections 42 from the holster body. These projections 42 may simply be cut from the second end portion by using a suitable tool. Thus, when the second end portion is bent into the position illustrated in FIG. 7, projections 44 register with and project into the uppermost recesses 48 along the rear face of intermediate portion 26 to define with flange 40 an opening of greater height or elevational extent. Consequently, to accomodate a wider belt, projections 42 are simply removed. However, the stability of the holster relative to the belt, e.g. the prevention of substantial rotational movement, both swinging and pivoting movement of the holster relative to the belt, is retained. Thus, the larger belt fits snugly into the opening defined by the opposed faces of the intermediate and second end portions 26 and 24, respectively, flange 40 and the abutments formed by projections 44 and which projections engage the holster body in the uppermost of recesses 48.

It will be apparent to those skilled in the art that various modifications could be made in the holster for chemical tear gas projector hereof without departing from the scope or spirit of the invention.

What is claimed is:

1. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body for adjusting the size of said opening to enable the holster to be carried by belts of different sizes, said adjusting means including a projection carried by one of said second end portion and said intermediate portion and projecting toward the other of said second end portion and said intermediate portion, said projection defining part of said opening and forming an abutment against which the belt may engage, means for releasably securing said first and second end portions one to the other, and means carried by said intermediate portion of said holster body and spaced from said receptacle for releasably engaging the chemical tear gas projector to retain the latter in the receptacle.

2. A holster according to claim 1 including a flange carried by one of said second end portion and said intermediate portion on the opposite side of said opening from said abutment and defining a second abutment whereby the belt is receivable in said opening for engagement with said abutments along the opposite edges of the belt.

3. A holster according to claim 1 including means carried by the other of said second end portion and said intermediate portion for engaging said projection and substantially preventing relative lateral movement of said projection and said engaging means.

4. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body for adjusting the size of said opening to enable the holster to be carried by belts of different sizes, said adjusting means including a pair of projections carried by one of said second end portion and said intermediate portion and spaced laterally one from the other to define a part of said opening and form a pair of laterally spaced abutments against which the belt may abut, means for releasably securing said first and second end portions one to the other, and means carried by said intermediate portion of said holster body and spaced from said receptacle for releasably engaging the chemical tear gas projector to retain the latter in the receptacle.

5. A holster according to claim 4 including a flange carried by one of said second end portion and said intermediate portion on the opposite side of said opening from said abutments and defining a second abutment whereby the belt is receivable in said opening for engagement with said abutments along the opposite edges of the belt.

6. A holster according to claim 4 including means carried by the other of said second end portion and said intermediate portion for engaging said projections and substantially preventing lateral movement of said projections and said engaging means.

7. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, and second end portion extending along the opposite side of said holster body adjacent and generally parallel to said intermediate portion thereof and defining therewith an opening for receiving a belt for supporting the holster therefrom, means carried by said holster body for adjusting the size of said opening to enable the holster to be carried by belts of different sizes, said adjusting means including first and second projections carried by one of said second end portion and said intermediate portion and projecting toward the other of said second end portion and said intermediate portion, said projections being spaced vertically one from the other with said first projection being removably carried by said one of said second end portion and said intermediate portion, said first projection defining a part of said opening of a first predetermined size and positioned to form an abutment against which a belt of a first predetermined size may abut, said second projection defining a part of said opening of a second predetermined size and forming an abutment against which a belt of a second predetermined size may abut upon removal of said first projection from said holster body, means for releasably securing said first and second end portions one to the other, and means carried by said intermediate portion of said holster body and spaced from said receptacle for releasably engaging the chemical tear gas projector to retain the latter in the receptacle.

8. A holster according to claim 7 including a flange carried by one of said second end portion and said intermediate portion on the opposite side of said opening from said abutments and defining another abutment whereby the belt is receivable in said opening of a predetermined size for engagement with said abutments along the opposite edges of the belt.

9. A holster according to claim 7 including means carried by the other of said second end portion and said intermediate portion for engaging said projections and substantially preventing relative lateral movement of said projections and said engagement means.

10. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body for adjusting the size of said opening to enable the holster to be carried by belts of different sizes, said adjusting means including first and second pairs of projections carried by one of said second end portion and said intermediate portion and projecting toward the other of said second end portion and said intermediate portion, said pairs of projections being spaced vertically one from the other with said first pair of projections being removably carried by said one of said second end portion and said intermediate portion, said first pair of projections being laterally spaced one from the other and providing a pair of laterally spaced abutments against which the belt may abut and which abutments define a part of said opening of a first predetermined size, said second pair of projections being laterally spaced one from the other and providing a pair of abutments against which the belt may abut and which abutments define an opening of a second predetermined size upon removal of said first pair of projections from said holster body, means for releasably securing said first and second end portions one to the other, and means carried by said intermediate portion of said holster body and spaced from said receptacle for releasably engaging the chemical tear gas projector to retain the latter in the receptacle.

11. A holster according to claim 10 including a flange carried by one of said second end portion and said intermediate portion on the opposite side of said opening from said abutments and defining another abutment whereby the belt is receivable in said opening for engagement with said abutments along the opposite edges of the belt.

12. A holster according to claim 10 including means carried by the other of said second end portion and said intermediate portion for engaging said projections and sunstantially preventing relative lateral movement of said projections and said engagement means.

13. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body and engagable with the belt for substantially preventing rotational movement of said holster body relative to the portion of the belt received in said opening, said preventing means including a projection carried by one of said second end portion and said intermediate portion and projecting toward the other of said second end portion and said intermediate portion, said projection defining a part of said opening and forming an abutment against which the belt may abut, a flange carried by one of said second end portion and said intermediate portion on the opposite side of said opening from said abutment and defining a second abutment whereby the belt is receivable in said opening for engagement with said abutments along the opposite edges of the belt, means for releasably securing said first and second end portions one to the other, and means carried by said intermediate portion of said holster body and spaced from said receptacle for releasably engaging the chemical tear gas projector to retain the latter in the receptacle.

14. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body and engagable with the belt for substantially preventing rotational movement of said holster body relative to the portion of the belt received in said opening, sad preventing means including a pair of projections carried by one of said second end portion and said intermediate portion and spaced laterally one from the other to efine a part of said opening and form a pair of laterally spaced abutments against which the belt may abut, and a flange carried by one of said second end portion and said intermediate portion on the opposite side of said opening from said abutments and defining another abutment whereby the belt is receivable in said opening for engagement with said abutments along the opposite edges of the belt, means for releasably securing said first and second end portions one to the other, and means carried by said intermediate portion of said holster body and spaced from said receptacle for releasably engaging the chemical tear gas projector to retain the latter in the receptacle.

15. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body and engagable with the belt for substantially preventing rotational movement of said holster body relative to the portion of the belt received in said opening, said preventing means including first and second projections carried by one of said second end portion and said intermediate portion and projecting toward the other of said second end portion and said intermediate portion, said projections being spaced vertically one from the other with said first projection being removably carried by the bolster body, said first projection defining a part of said opening of a first predetermined size and positioned to form an abutment against which a belt of a first predetermined size may abut, said second projection defining a part of said opening of a second predetermined size and forming an abutment against which a belt of a second predetermined size may abut upon removal of said first projection from said holster body, a flange carried by one of said second end portion and said intermediate portion on the opposite side of said opening from said abutments and defining another abutment whereby the belt is receivable in said opening of a predetermined size for engagement with said abutments along the opposite edges of the belt, means for releasably securing said first and second end portions one to the other, and means carried by said intermediate portion of said holster body and spaced from said receptacle for releasably engaging the chemical tear gas projector to retain the latter in the receptacle.

16. A holster for a chemical tear gas projector comprising:

an elongated holster body having first and second end portions and an intermediate portion therebetween, said first end portion including an upwardly opening receptacle on one side of said holster body for receiving a portion of the chemical tear gas projector, said second end portion extending along the opposite side of said holster body adjacent and generally parallel to said intermediate portion thereof and defining therewith an opening for receiving a belt for supporting the holster therefrom, means carried by said holster body and engagable with the belt for substantially preventing rotational movement of said holster body relative to the portion of the belt received in said opening, said preventing means including first and second pairs of projections carried by one of said second end portion and said intermediate portion and projecting toward the other of said second end portion and said intermediate portion, said pairs of projections being vertically spaced one from the other with said first pair of projections being removably carried by said holster body, said first pair of projections being laterally spaced one from the other and providing a pair of laterally spaced abutments against which the belt may abut and which abutments define a part of said opening of a first predetermined size, said second pair of projections being laterally spaced one from the other and providing a pair of abutments against which the belt may abut and which abutments define an opening of a second predetermined size upon removal of said first pair of projections from said holster body, a flange carried by one of said second end portion and said intermediate portion on the opposite side of said opening from said abutments and defining another abutment whereby the belt is receivable in said opening for engagement with said abutments along the opposite edges of the belt, means for releasably securing said first and second end portions one to the other, and means carried by said intermediate portion of said holster body and spaced from said receptacle for releasably engaging the chemical tear gas projector to retain the latter in the receptacle.

* * * * *